US007634898B2

(12) United States Patent
Crook

(10) Patent No.: US 7,634,898 B2
(45) Date of Patent: Dec. 22, 2009

(54) MODIFIED SEAM PRESS FABRIC

(75) Inventor: Robert Crook, Wilson, NC (US)

(73) Assignee: Voith Paper GmbH, Heidenheim (DE)

( * ) Notice: Subject to any disclaimer, the term of this patent is extended or adjusted under 35 U.S.C. 154(b) by 0 days.

(21) Appl. No.: 11/654,454

(22) Filed: Jan. 17, 2007

(65) Prior Publication Data

US 2007/0163741 A1 Jul. 19, 2007

Related U.S. Application Data

(60) Provisional application No. 60/759,647, filed on Jan. 17, 2006.

(51) Int. Cl.
*D02G 3/36* (2006.01)

(52) U.S. Cl. ..... 57/210

(58) Field of Classification Search ..... 57/210, 57/232

See application file for complete search history.

(56) References Cited

U.S. PATENT DOCUMENTS

| | | | | |
|---|---|---|---|---|
| 3,613,258 | A * | 10/1971 | Jamieson | 34/95 |
| 4,350,731 | A * | 9/1982 | Siracusano | 442/270 |
| 4,382,987 | A * | 5/1983 | Smart | 428/212 |
| 5,466,339 | A | 11/1995 | Legge | |
| 5,549,957 | A | 8/1996 | Negola et al. | |
| 6,062,014 | A * | 5/2000 | Yeh | 57/232 |
| 7,155,891 | B2 * | 1/2007 | Bader | 57/210 |

FOREIGN PATENT DOCUMENTS

WO 03071026 A2 8/2003

* cited by examiner

*Primary Examiner*—Shaun R Hurley
(74) *Attorney, Agent, or Firm*—Bachman & LaPointe, P.C.

(57) ABSTRACT

A fabric for a paper machine includes a base having a paper side and a roll side; a roll side batt layer attached to the roll side of the base; and a plurality of yarns embedded in the roll side batt layer. The yarns can be mono or multifilament yarns, and can be yarn cores in elastomer sheathes.

14 Claims, 1 Drawing Sheet

MODIFIED SEAM PRESS FABRIC

CROSS REFERENCE TO PROVISIONAL APPLICATION

This application claims the benefit of the filing date of provisional patent application 60/759,647 filed Jan. 17, 2006.

BACKGROUND OF THE INVENTION

The invention relates to seamed fabric for use in the press section of a papermaking machine.

Paper is conventionally manufactured by conveying a paper furnish, usually consisting of an initial slurry of cellulosic fibers, on a forming fabric or between two forming fabrics in a forming section, the nascent sheet then being passed through a pressing section and ultimately through a drying section of a papermaking machine. In the case of standard tissue paper machines, the paper web is transferred from the press fabric to a Yankee dryer cylinder then creped.

Paper machine fabric or clothing is essentially employed to carry the paper web through these various stages of the papermaking machine. In the forming section, the fibrous furnish is wet-laid onto a moving forming wire and water is encouraged to drain from it by means of suction boxes and foils. The paper web is then transferred to a press fabric that conveys it through the pressing section, where it usually passes through a series of pressure nips formed by rotating cylindrical press rolls. Water is squeezed from the paper web and into the press fabric as the web and fabric pass through the nip together. Press fabrics generally comprise a batt of fibers needled to a base fabric. In the final stage, the paper web is transferred either to a Yankee dryer, in the case of tissue paper manufacture, or to a set of dryer cylinders upon which, aided by the clamping action of the dryer fabric, the majority of the remaining water is evaporated.

The base fabrics of press felts are woven endless, whether they are seamed or not, such that the yarns of the weft in the loom lie in the machine direction of the fabric on the paper machine. The weft yarns weave back and forth continuously between the laterally extending edges of the fabric and form a seam loop at the reversals on one side. The two ends formed are then joined together on the machine by means of a pintle wire.

Press felts consist of multiple layers which are secured together by needling. This works by mechanically locking the constituent batt fibers into various layers and in so doing holds them together. In addition, the batt fiber gives a homogenous paper support surface. Due to the method of base fabric manufacture, the area around the seam is free of cross machine direction (CD) yarns. This means that the ability of the batt fiber to become anchored in this region is much reduced, and the anchoring achieved much less effective than in the main area of the felt. Also, due to the greater void volume in the seam area, in comparison to the main body of the fabric, the propensity to marking of the paper sheet is greatly increased. Efforts to address this problem include those described in U.S. Pat. No. 5,466,339 where extruded monofilaments are secured to the underside of the fabric in the machine direction. These extruded monofilaments help to express water but the extrusion process is expensive and time consuming.

The need remains for a solution to issues with the seam area of a seam felt with reduced cost and without special protection for the seam loops.

SUMMARY OF THE INVENTION

According to the invention, a modified seam press fabric is provided which helps provide better void volume, caliper and drainage channels, and which also dampens vibrations, without requiring special protection for the seam loops and without the need for special extrusion processes.

According to the invention, a fabric for a paper machine is provided which comprises a base having a paper side and a roll side; a roll side batt layer attached to the roll side of the base; and a plurality of yarns embedded in the roll side batt layer.

The yarns are preferably yarn cores in sheathes. The sheath can comprise a low melt resin, and the low melt resin can be a thermoplastic polyurethane elastomer. After positioning along the fabric, embedded in batt material, the sheath can be thermally fused to the surrounding batt, thereby fixing the yarns in place without an extrusion process and the complications which accompany an extrusion process.

BRIEF DESCRIPTION OF THE DRAWINGS

A detailed description of preferred embodiments of the invention follows with reference to the attached drawings wherein.

DETAILED DESCRIPTION

The invention relates to a press fabric for a paper making machine and, more particularly, to a seam press fabric having a modified structure.

Figure 1:
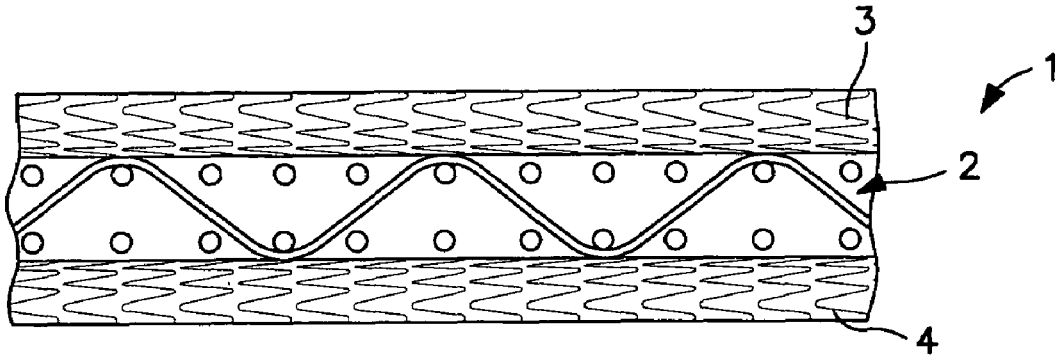
FIG. 1 (PRIOR ART)
FIG. 1 is a cross section taken through a prior art press fabric.

FIG. 1 shows a prior art press fabric 1 as described above, having a fabric base 2 with batt layers 3, 4 on each side of the fabric base 2.

Figure 2:
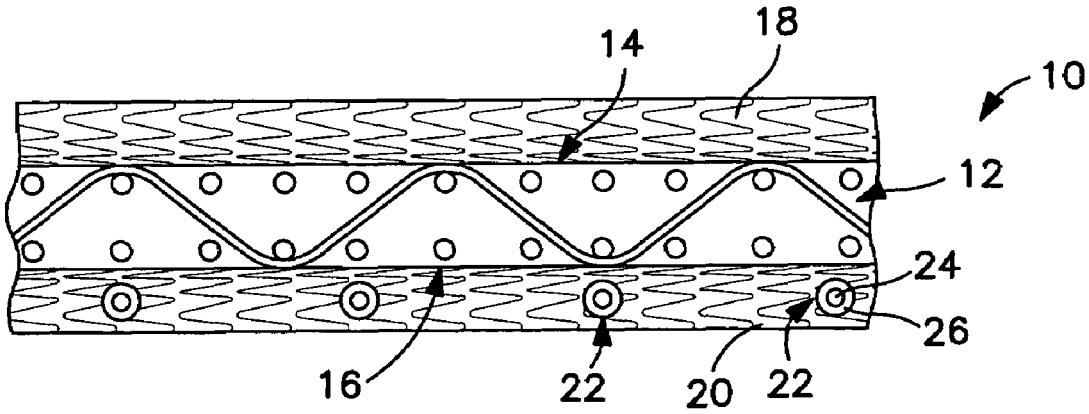
FIG. 2 is a cross section taken through a fabric according to the present invention.

FIG. 2 shows a press fabric 10 according to the invention, having a fabric base 12 which has a paper side 14 and a roll side 16, a paper side batt layer 18 attached to the paper side 14, a roll side batt layer 20 attached to the roll side 16, and a plurality of additional yarns 22 attached to fabric 10 and embedded into roll side batt layer 20.

Yarns 22 are preferably held in place by bonding yarns 22 relative to roll side batt layer 20. This bonding can be accomplished in a variety of ways, but a preferred approach is to bond yarns 22 to batt layer 20 using a low melt adhesive to thermally bond yarns 22 and batt layer 20. This adhesive can be in the form of low melt particles or adhesive fibers, or a sheath around the yarn as will be further described below.

According to the invention, yarns 22 can be provided as cross head extruder yarns, preferably having a yarn core 24 and a sheath 26 which can be made of a low melt resin such as a thermoplastic polyurethane elastomer or the like. Yarn core 24 can be a mono or multi filament yarn, and is preferably stretch resistant. Suitable examples include a yarn core from 200 to 2,000 denier, preferably about 500 denier. Suitable material includes polyamide, polyester and the like, preferably which stretches less than 5% with a 0.5 lb load.

Yarns 22 are preferably positioned in the machine direction, and help to provide good properties to the fabric. Yarns 22 can be secured by melting the sheath on the yarn, and this helps to keep yarns 22 in place with respect to the batt layer, without requiring any steps which would clog or otherwise damage the seaming loops, and thereby without requiring any special protection for such loops such as flaps or the like.

Further, the elastomer sheath serves to provide dampening of vibration along with desirable void volume, caliper and drainage characteristics.

Yarns 22 can be attached to the roll side batt layer 20 and/or fabric base 12 by simple winding, needle punching, partial surface melting, low melt adhesive fibers, low melt adhesive particles and the like or could be applied as a woven laminate with relatively small diameter "binder" yarns used in the cross direction. Such cross direction binder yarns could also be provided from water soluble material.

A relatively low number of yarns per inch has been found to be surprisingly effective at staying open, adding void area for water handling, and staying clean while adding only minimal weight. Yarns are preferably attached to the fabric at between 4 and 24 yarns per inch, more preferably between 6 and 12 yarns per inch, and most preferably at 8 yarns per inch. The yarns preferably have a diameter of between 0.3 mm and 1.2 mm, more preferably between 0.5 mm and 1.0 mm.

As set forth above, yarns 22 provide good support for roll side batt layer 20, and the elastomer also helps to dampen vibration which can be caused, especially by the seam of the fabric. The yarn structure allows the yarns to be attached to the fabric, preferably by thermal fusion, a method which does not require seam protection, unlike direct extrusion processes of known methods.

For seam preparation, normal procedures can be used, that is, the roll side batt with embedded yarn can be removed as normal to permit "tenting" of the seam and to ease pinning of the seam on a paper machine.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

The invention claimed is:

1. A fabric for a paper machine, said fabric having a seam and comprising:

a base having a paper side and a roll side;

a roll side batt layer attached to the roll side of the base; and a plurality of yarns embedded in the roll side batt layer, wherein the plurality of yarns comprises a yarn core in a sheath, said sheath comprising a low melt resin, and wherein the base comprises yarns which are no core/sheath yarns.

2. The fabric of claim 1, wherein the yarn cores are nylon or polyester multifilament yarns.

3. The fabric of claim 1, wherein the low melt resin comprises a thermoplastic polyurethane elastomer.

4. The fabric of claim 1, wherein the plurality of yarns are present on the fabric in an amount of between 4 and 24 yarns per inch.

5. The fabric of claim 1, wherein the plurality of yarns are present on the fabric in an amount between 6 and 12 yarns per inch.

6. The fabric of claim 1, wherein each of the plurality of yarns has a diameter of between 0.3 mm and 1.2 mm.

7. The fabric of claim 1, wherein each of the plurality of yarns has a diameter of between 0.5 mm and 1.0 mm.

8. The fabric of claim 1, wherein the yarns are cross head extruded yarns.

9. The fabric of claim 1, wherein the yarns are attached to the roll side of the base.

10. The fabric of claim 9, wherein the yarns are fused to the roll side batt layer.

11. A method for making a fabric for a paper machine, comprising the steps of:

providing a fabric comprising a base having a paper side and a roll side; and a roll side batt layer attached to the roll side of the base;

embedding a plurality of yarns in the roll side batt layer; and bonding the plurality of yarns to the roll side batt layer, wherein the plurality of yarns comprises a yarn core in a sheath and the bonding step comprises thermally fusing the sheath to the roll side batt layer, and wherein the base comprises yarns which are no core/sheath yarns.

12. The method of claim 11, wherein the fabric has a seam.

13. The fabric of claim 1, wherein the no core/sheath yarns of the base are yarns without a sheath.

14. The method of claim 11, wherein the no core/sheath yarns of the base are yarns without a sheath.

* * * * *